US005889502A

United States Patent [19]

Iwama

[11] Patent Number: 5,889,502

[45] Date of Patent: Mar. 30, 1999

[54] DISCHARGE VOLTAGE CONTROL FOR PLASMA ADDRESSED DISPLAY DEVICE

[75] Inventor: Jun Iwama, Kanagawa, Japan

[73] Assignee: Sony Corporation, Tokyo, Japan

[21] Appl. No.: 781,319

[22] Filed: Jan. 10, 1997

[30] Foreign Application Priority Data

Jan. 12, 1996 [JP] Japan ..... 8-022032

[51] Int. Cl.[6] ..... G09G 3/28

[52] U.S. Cl. ..... 345/60; 345/66; 313/581; 313/582; 315/169.4

[58] Field of Search ..... 345/60, 66; 313/581, 313/582, 584, 590, 231.31; 315/169.4, 194, 197, 199, 291, DIG. 7

[56] References Cited

U.S. PATENT DOCUMENTS

| | | | |
|---|---|---|---|
| 5,583,527 | 12/1996 | Fujisaki et al. | 345/60 X |
| 5,661,501 | 8/1997 | Tanamachi | 345/60 |
| 5,684,362 | 11/1997 | Togawa | 313/582 |
| 5,696,522 | 12/1997 | Iwama | 345/60 |
| 5,745,085 | 4/1998 | Tomio et al. | 345/63 |

FOREIGN PATENT DOCUMENTS

| | | |
|---|---|---|
| 0 701 239 | 3/1996 | European Pat. Off. . |
| 0 715 292 | 6/1996 | European Pat. Off. . |

OTHER PUBLICATIONS

Japanese Abstract, vol. 95, No. 012, Dec. 8, 1995, JP 07319425.

*Primary Examiner*—Steven J. Saras
*Assistant Examiner*—Seth D. Vail
*Attorney, Agent, or Firm*—Hill & Simpson

[57] ABSTRACT

Disclosed herein is a plasma addressed display device which can adaptively control a voltage to be applied to each discharge channel, thereby suppressing an excess applied voltage. The plasma addressed display device includes a flat panel as a display. The flat panel has a laminated structure consisting of a plasma cell having a plurality of rows of discharge channels and a display cell having a plurality of columns of signal electrodes. A drive circuit sequentially supplies an applied voltage to a cathode in each discharge channel to generate a plasma discharge, thereby performing line-sequential scanning. A signal circuit supplies an image signal to each signal electrode in synchronism with the line-sequential scanning. A constant-current circuit operates so that a constant discharge current flows after the generation of the plasma discharge in each discharge channel. A detecting circuit samples a discharge voltage during flowing of the constant discharge current in each discharge channel. A control circuit adaptively controls the applied voltage to be supplied to each discharge channel according to the sampled discharge voltage.

6 Claims, 8 Drawing Sheets

DISCHARGE VOLTAGE CONTROL FOR PLASMA ADDRESSED DISPLAY DEVICE

BACKGROUND OF THE INVENTION

The present invention relates to a plasma addressed display device, and more particularly to a technique for adaptively controlling a voltage to be applied to each discharge channel by line-sequential scanning.

A plasma addressed flat panel employing a plasma cell for addressing of a display cell is known from Japanese Patent Laid-open No. 4-265931, for example. As shown in FIG. 6, such a flat panel 0 is composed of a display cell 1, a plasma cell 2, and a common intermediate substrate 3 interposed between the display cell 1 and the plasma cell 2. The intermediate substrate 3 is formed from a very thin glass plate or the like, which is called a microsheet. The plasma cell 2 is configured by a lower substrate 4 bonded to the intermediate substrate 3 with a gap defined therebetween. The gap is filled with an ionizable gas. A plurality of parallel stripes of discharge electrodes 5 are formed on the inside surface of the lower substrate 4. The discharge electrodes 5 may be printed and baked on the flat substrate 4 by screen printing or the like. A plurality of barrier ribs 6 are formed on the inside surface of the lower substrate 4 in such a manner that each barrier rib 6 partitions any adjacent pairs of the discharge electrodes 5, thereby dividing the gap filled with the ionizable gas into a plurality of discharge channels 7. The barrier ribs 6 may also be printed and baked by screen printing or the like. The top of each barrier rib 6 is in contact with the lower surface of the intermediate substrate 3. Each pair of discharge electrodes 5 function as an anode A and a cathode K, between which a plasma discharge is generated. The intermediate substrate 3 and the lower substrate 4 are bonded to each other through a glass frit 8 or the like.

On the other hand, the display cell 1 is configured by a transparent upper substrate 9. The upper substrate 9 is bonded to the upper surface of the intermediate substrate 3 through a sealing member 10 or the like, so that a given gap is defined between the upper substrate 9 and the intermediate substrate 3. This gap is filled with an electro-optic substance such as a liquid crystal 11. A plurality of parallel stripes of signal electrodes 12 are formed on the inside surface of the upper substrate 9. The signal electrodes 12 perpendicularly intersect the discharge electrodes 5, so that a plurality of pixels forming a matrix are defined at the intersections between the signal electrodes 12 and the discharge channels 7.

In the plasma addressed flat panel 0 having such a configuration, the rows of discharge channels 7 in which the plasma discharge is generated are line-sequentially switched to be scanned, and in synchronism with this line-sequential scanning an image signal is applied to each signal electrode 12 of the display cell 1, thereby displaying an image. When the plasma discharge is generated in each discharge channel 7, the interior of each discharge channel 7 uniformly becomes an anode potential to thereby select pixels row by row. That is, each discharge channel functions as a sampling switch. When an image signal is applied to each pixel in an on-state of the plasma sampling switch, sampling is performed to allow on/off control of each pixel. Even after the plasma sampling switch goes off, the image signal is held in each pixel as it stands.

FIG. 7 is a block diagram showing a general configuration of a plasma addressed display device employing the flat panel 0 shown in FIG. 6 as a display. The display cell 1 and the plasma cell 2 are laminated together to form an effective screen 20. A signal circuit 21 is connected to the signal electrodes 12 of the display cell 1 to supply an image signal to each signal electrode 12. The anodes A of the plasma cell 2 are commonly connected to a grounding terminal of a main power supply 22. A negative terminal voltage of the main power supply 22 is represented by −Vk. The cathodes K are connected to a drive circuit 23. The drive circuit 23 is configured by a plurality of switching elements such as transistors. When the switching elements sequentially go on/off, the plasma discharge in each discharge channel is moved from an upper portion to a lower portion of the screen 20. A discharge current flows from the anode A to the cathode K in each discharge channel, and then passes through the corresponding switching element to a constant-current circuit 24. The constant-current circuit 24 controls a cathode potential Vo to limit the discharge current to a constant value. The constant-current circuit 24 is supplied with a voltage Va from an auxiliary power supply 25.

FIG. 8 is a circuit diagram showing an illustrative configuration of the constant-current circuit 24 shown in FIG. 7. The constant-current circuit 24 shown in FIG. 8 is a current mirror circuit composed mainly of a pair of transistors Tr0 and Tr1. The cathode potential Vo is controlled so that the same current as the current determined by the voltage Va of the auxiliary power supply and a resistance R flows into the transistor Tr0. A diode Di serves as a bypass for supplying a constant current to the transistor Tr0 during a period when the switching elements are off (i.e., during a nondischarge period). In the case of this constant-current circuit, the current flows from the diode Di to the transistor Tr0 during the nondischarge period, so that the cathode potential Vo becomes −Vk+Va.

The operation of the constant-current circuit shown in FIG. 8 will now be described in brief with reference to FIG. 9. At a discharge timing when each switching element of the drive circuit goes on, the above-mentioned potential −Vk+Va is initially applied to the cathode. This applied voltage is the same to all the discharge channels. When the discharge starts, the discharge current flows into the transistor Tr0, and the cathode potential Vo changes according to the magnitude of the flowing discharge current. An amount of change in the cathode potential Vo varies with time and variations in characteristics between the discharge channels.

As mentioned above, the conventional plasma addressed display device employs an active load such as the constant-current circuit as means for limiting the discharge current. In this case, when the discharge starts, the potential during the nondischarge period is initially applied between the anode and the cathode. This applied voltage is fixed to the constant value −Vk+Va by the main power supply and the auxiliary power supply. This applied voltage must be preliminarily set to a large value in consideration of variations in discharge characteristics between the discharge channels and aged changes in the discharge characteristics. As a result, until the discharge current reaches a constant value by the operation of the constant-current circuit, an excess voltage higher than a voltage required by the discharge channel is applied between the anode and the cathode. Accordingly, a local arc discharge is generated to damage the electrodes and resultantly shorten the life of the flat panel.

SUMMARY OF THE INVENTION

It is accordingly an object of the pi to provide a plasma addressed display device which can adaptively control a voltage to be applied to each discharge channel, thereby suppressing an excess applied voltage.

According to the present invention, there is provided a plasma addressed display device comprising a flat panel, a drive circuit, a signal circuit, a constant-current circuit, a detecting circuit, and a control circuit. The flat panel is formed by laminating a plasma cell having a plurality of rows of discharge channels and a display cell having a plurality of columns of signal electrodes. The drive circuit sequentially supplies an applied voltage to each discharge channel to generate a plasma discharge in each discharge channel, thereby performing line-sequential scanning. The signal circuit supplies an image signal to each signal electrode in synchronism with the line-sequential scanning. The constant-current circuit operates so that a constant discharge current flows after generation of the plasma discharge in each discharge channel. As a feature of the present invention, the detecting circuit samples a discharge voltage during flowing of the constant discharge current in each discharge channel, and the control circuit adaptively controls the applied voltage to be supplied to each discharge channel according to the discharge voltage sampled by the detecting circuit. More specifically, the control circuit sets the applied voltage by adding a constant voltage value to a value of the sampled discharge voltage. In one embodiment, the control circuit controls the applied voltage to be supplied to the discharge channel of the next row according to the discharge voltage sampled from the discharge channel of a present row. In another embodiment, the control circuit controls the applied voltage to be supplied to each discharge channel row by row in the line-sequential scanning at the next time according to the sampled discharge voltage in each discharge channel in the line-sequential scanning at a present time.

As mentioned above, according to the present invention, the voltage to be applied between the anode and the cathode at a discharge start timing in each discharge channel is dynamically controlled. That is, means for sampling the discharge voltage in each discharge channel is provided, and the applied voltage between the anode and the cathode is changed according to a sampled value of the discharge voltage by the sampling means. Thus, by sampling the discharge voltage in each discharge channel and applying a voltage near the sampled value to each discharge channel at the discharge start timing, application of an excess voltage can be suppressed.

Other objects and features of the invention will be more fully understood from the following detailed description and appended claims when taken with the accompanying drawings.

DETAILED DESCRIPTION OF THE PREFERRED EMBODIMENTS

Figure 1:
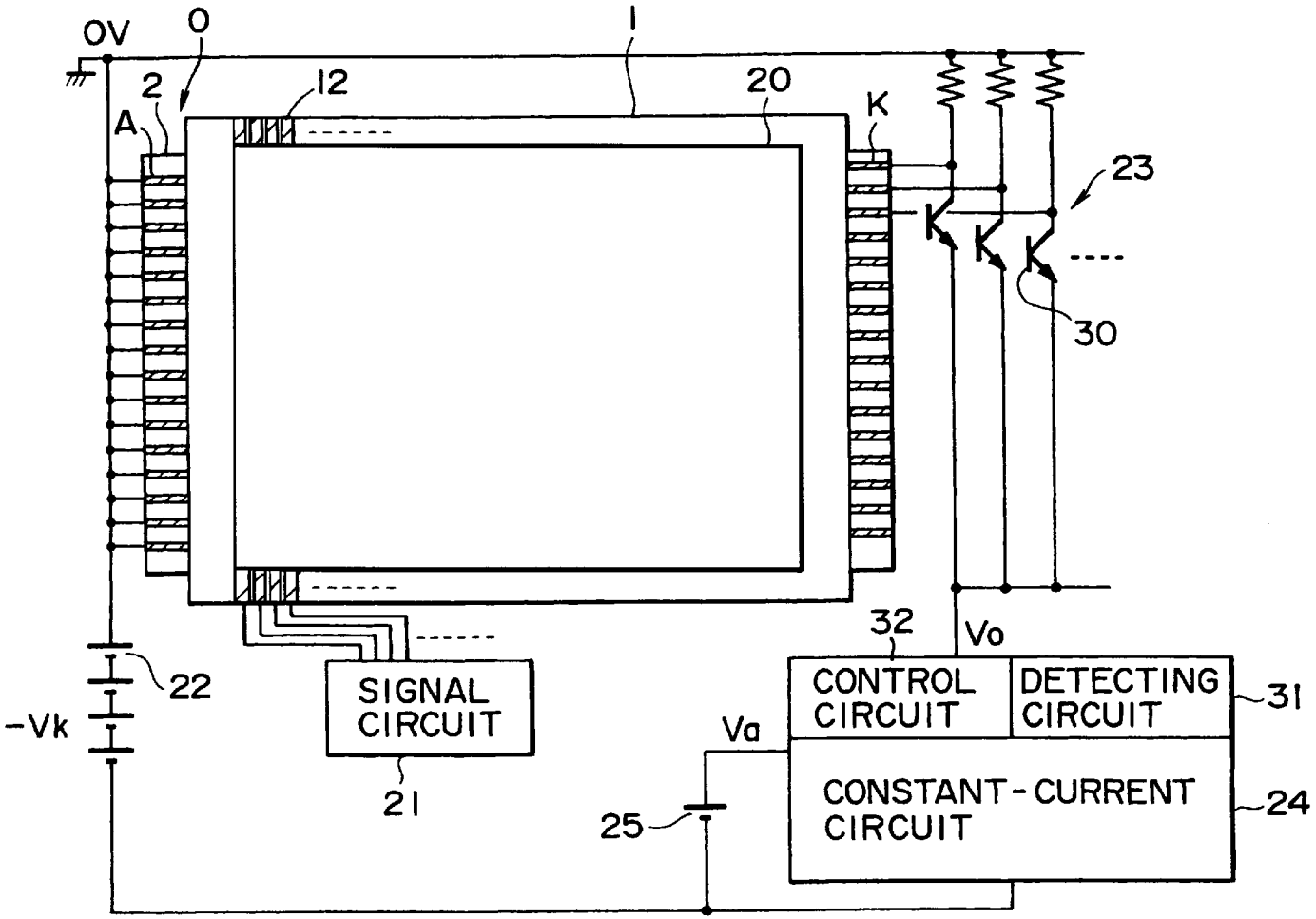
FIG. 1 is a block diagram showing a first preferred embodiment of the plasma addressed display device according to the present invention.

Some preferred embodiments of the plasma addressed display device according to the present invention will now be described in detail with reference to the drawings. FIG. 1 is a block diagram showing a first preferred embodiment of the plasma addressed display device according to the present invention. As shown in FIG. 1, the plasma addressed display device employs a flat panel 0 as a display. The flat panel 0 consists of a plasma cell 2 having a plurality of rows of discharge channels and a display cell 1 having a plurality of columns of signal electrodes 12. Each discharge channel consists of a pair of anode A and cathode K. Intersections between the discharge channels and the signal electrodes 12 constitute an effective screen 20. All the anodes A are commonly connected to a grounding terminal of a main power supply 22. The main power supply 22 has a constant output voltage −Vk. A drive circuit 23 is connected to the plasma cell 2 to sequentially supply an applied voltage to each discharge channel and generate a plasma discharge in each discharge channel, thereby performing line-sequential scanning. More specifically, the drive circuit 23 includes a plurality of switching elements 30 such as transistors, which are connected respectively to the corresponding cathodes K. The switching elements 30 sequentially go on/off to thereby move the plasma discharge in each discharge channel from an upper portion to a lower portion of the screen 20. On the other hand, a signal circuit 21 is connected to the display cell 1 to supply an image signal to each signal electrode 12 in synchronism with the line-sequential scanning, thereby displaying an image on the screen 20.

The plasma addressed display device in this preferred embodiment includes a constant-current circuit 24, which operates so that a constant discharge current flows after generation of the plasma discharge in each discharge channel. This discharge current flows from the anode A to the cathode K in each discharge channel, and next passes through each switching element 30 to the constant-current circuit 24, then returning to the main power supply 22. The constant-current circuit 24 controls to raise or lower a cathode potential Vo, thereby limiting the discharge current to a constant value. The plasma addressed display device in this preferred embodiment further includes a detecting circuit 31 for sampling a discharge voltage during flowing of the discharge current in each discharge channel, and a control circuit 32 for adaptively controlling the applied voltage to be supplied to each discharge channel according to the sampled discharge voltage. More specifically, the control circuit 32 sets the applied voltage by adding a constant voltage value to a value of the sampled discharge voltage. In this preferred embodiment, the control circuit 32 controls the applied voltage to be supplied to the discharge channel of the next row according to the sampled discharge voltage from the discharge channel of a present row.

Figure 2:
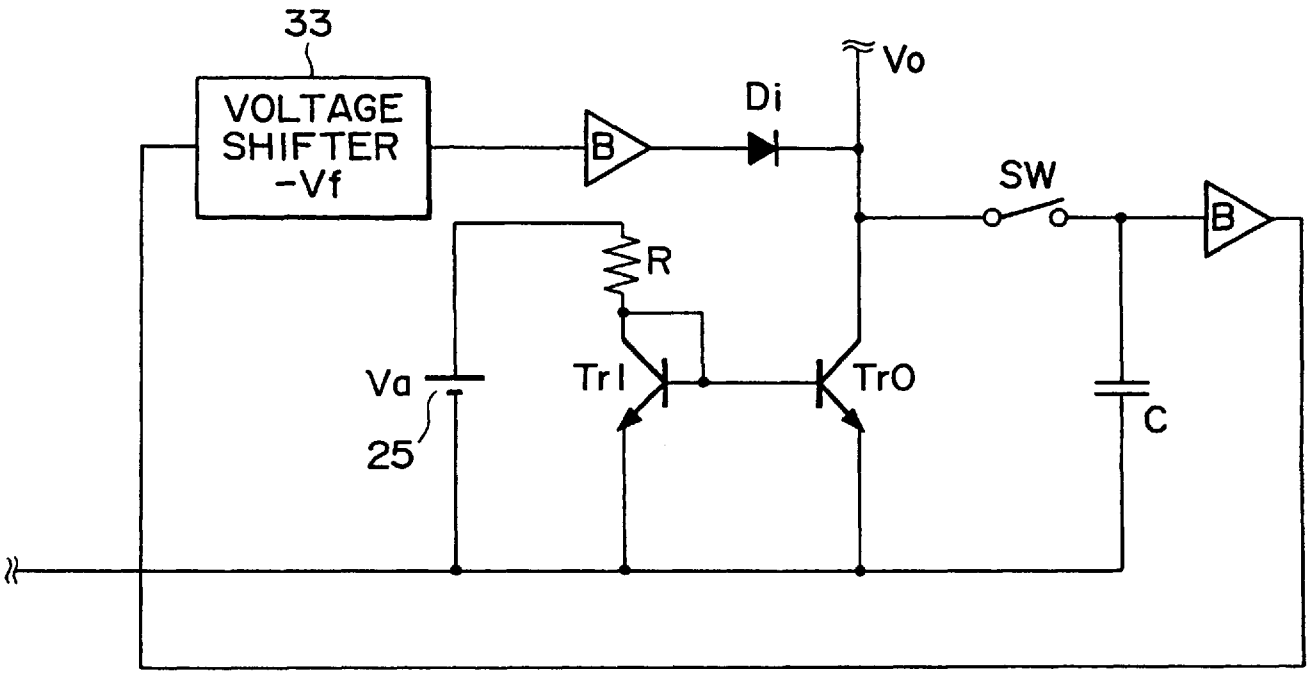
FIG. 2 is a circuit diagram showing a specific configuration of a constant-current circuit, a control circuit, and a detecting circuit incorporated in the plasma addressed display device shown in FIG. 1.

FIG. 2 is a circuit diagram showing a specific configuration of the constant-current circuit 24, the detecting circuit 31, and the control circuit 32 shown in FIG. 1. As shown in FIG. 2, the constant-current circuit includes a pair of transistors Tr0 and Tr1 connected in a current mirror configuration. This constant-current circuit controls the cathode potential Vo so that the same current as the current determined by an output voltage Va of an auxiliary power supply 25 and a resistance R flows into the transistor Tr0. That is, the discharge current finally becomes the same as the current determined by Va and R by the operation of the constant-current circuit. The detecting circuit consists of a sampling switch SW and a sampling capacitor C. The control circuit consists of a voltage shifter 33 connected through a buffer B to the sampling capacitor C and a diode Di connected through another buffer B to the voltage shifter 33.

Figure 3:
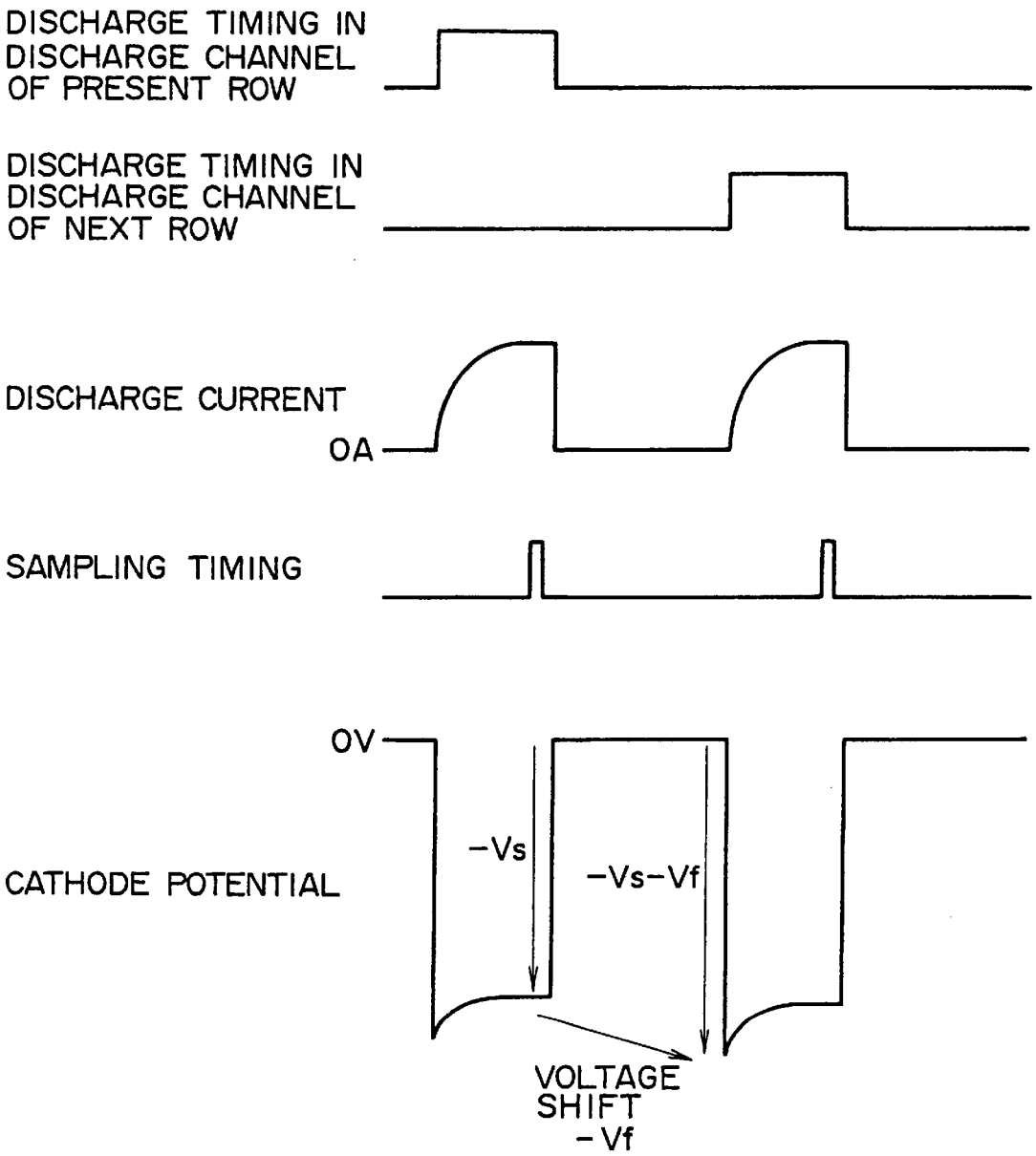
FIG. 3 is a waveform chart for illustration of the operations of the circuits shown in FIG. 2.

The operations of the constant-current circuit, the detecting circuit, and the control circuit shown in FIG. 2 will now be described in detail with reference to FIG. 3. At a discharge timing of the discharge channel of a present row, a voltage is applied between the anode and the cathode in this discharge channel to generate a plasma discharge. As a result, a discharge current starts flowing. At a sampling timing when the discharge current becomes a substantially constant value by the operation of the constant-current circuit, the sampling switch SW goes on to sample the cathode potential Vo. Letting −Vs denote this sampled potential, a difference between the output voltage Vk of the main power supply 22 and Vs is sampled in the sampling capacitor C in the case of the configuration shown in FIG. 2. When the plasma discharge in the discharge channel of the present row is finished, a current flows from the diode Di to the transistor Tr0. At this time, the diode Di is fixed at a voltage shifted by a constant value −Vf from the sampled voltage. As a result, the value of the cathode potential Vo becomes −Vs−Vf at this time. Accordingly, an initial value of the cathode voltage in the discharge channel of the next row becomes −Vs−Vf. In this manner, the voltage shifted by −Vf from the discharge voltage in the discharge channel of the present row is sequentially set as the output potential (cathode potential) of the constant-current circuit during a nondischarge period. Since any adjacent ones of the discharge channels have substantially similar discharge characteristics, a minimum required voltage can be applied to the cathode owing to the above setting, thus realizing stable discharge. That is, since there is a strong correlation in operational characteristics between the adjacent discharge channels, an initial voltage to be applied to the discharge channel of the next row can be set according to the discharge voltage sampled from the discharge channel of the present row. Furthermore, the discharge voltage is always detected in this preferred embodiment, the plasma discharge can be stably maintained irrespective of possible aged changes in discharge characteristics. The shift voltage −Vf set by the voltage shifter 33 is suitably decided by consideration of variations in discharge characteristics between the discharge channels and a discharge starting voltage for stably starting the plasma discharge.

Figure 4:
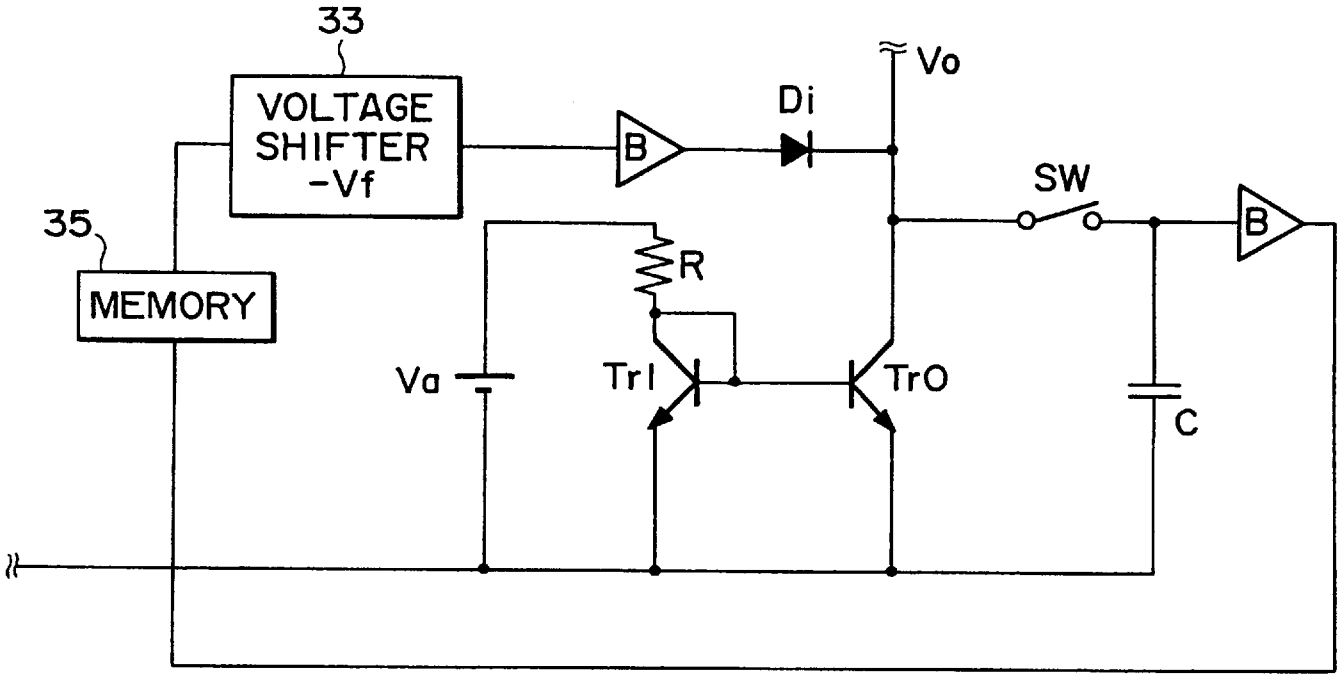
FIG. 4 is a circuit diagram showing a second preferred embodiment of the plasma addressed display device according to the present invention.

FIG. 4 is a circuit diagram showing a second preferred embodiment of the plasma addressed display device according to the present invention. The second preferred embodiment has the same basic configuration as that of the first preferred embodiment shown in FIG. 2, and the same parts are denoted by the same reference numerals for ease of understanding. The difference between the first preferred embodiment and the second preferred embodiment is that the second preferred embodiment additionally includes a memory 35 inserted between the sampling capacitor C and the voltage shifter 33. In the first preferred embodiment, the applied voltage to the discharge channel of the next row is decided with reference to the discharge voltage in the discharge channel of the present row. To the contrary, the second preferred embodiment includes the memory 35 for storing sampled discharge voltages in one field (one image on the screen), so as to sample the discharge voltages in the field and set them as reference values, then deciding the applied voltage to each discharge channel according to the reference values. That is, the control circuit according to this preferred embodiment controls the applied voltage to be supplied to each discharge channel row by row in the line-sequential scanning at the next time according to the discharge voltage in each discharge channel sampled in the line-sequential scanning at a present time.

Figure 5:
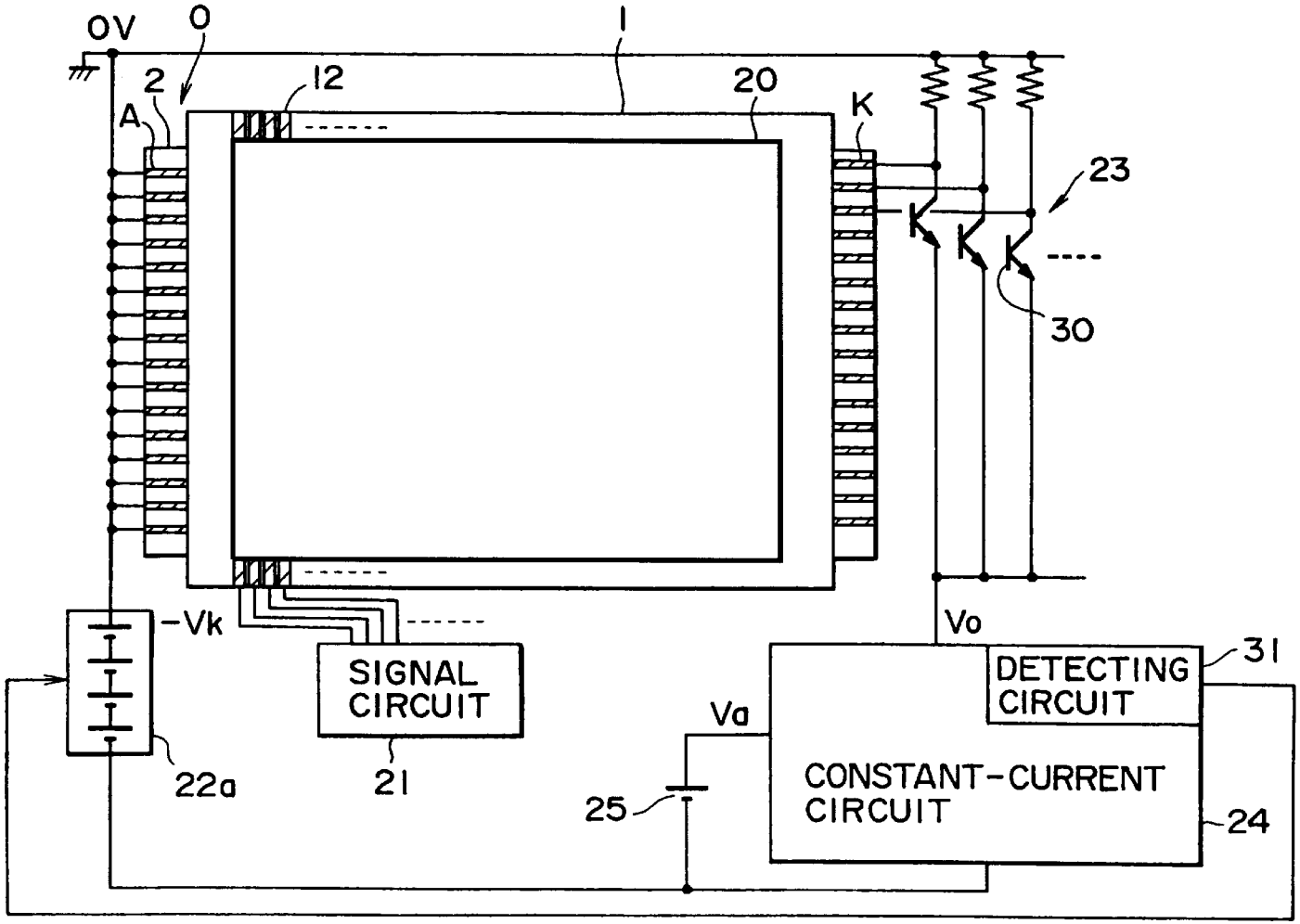
FIG. 5 is a block diagram showing a third preferred embodiment of the plasma addressed display device according to the present invention.
Figure 6:
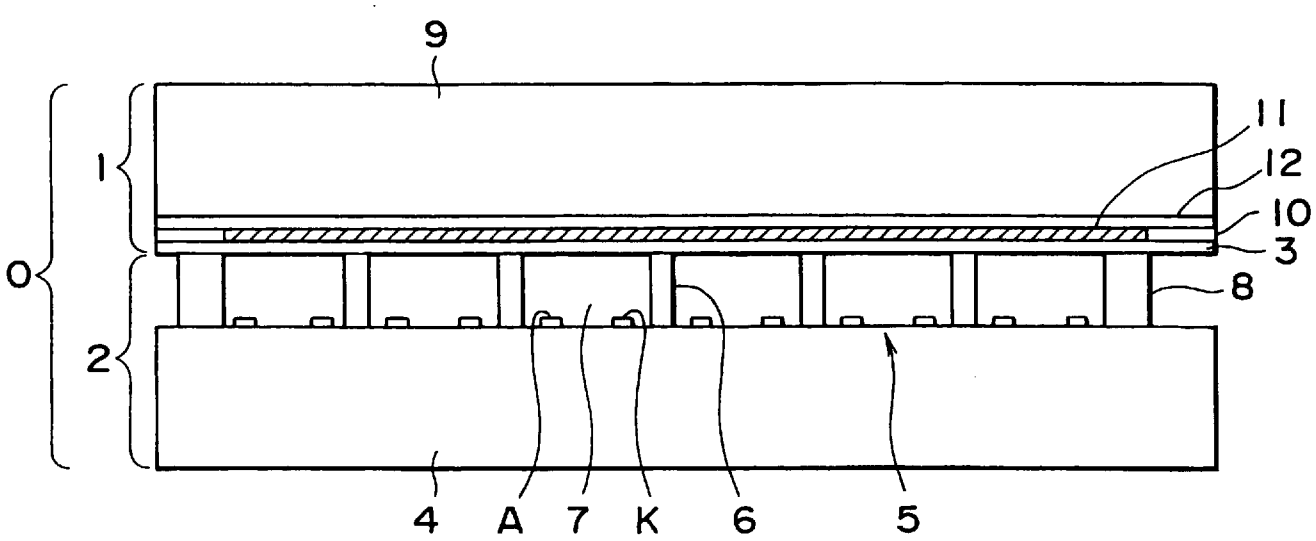
FIG. 6 (PRIOR ART)
FIG. 6 is a sectional view showing the configuration of a plasma addressed flat panel in the related art.
Figure 7:
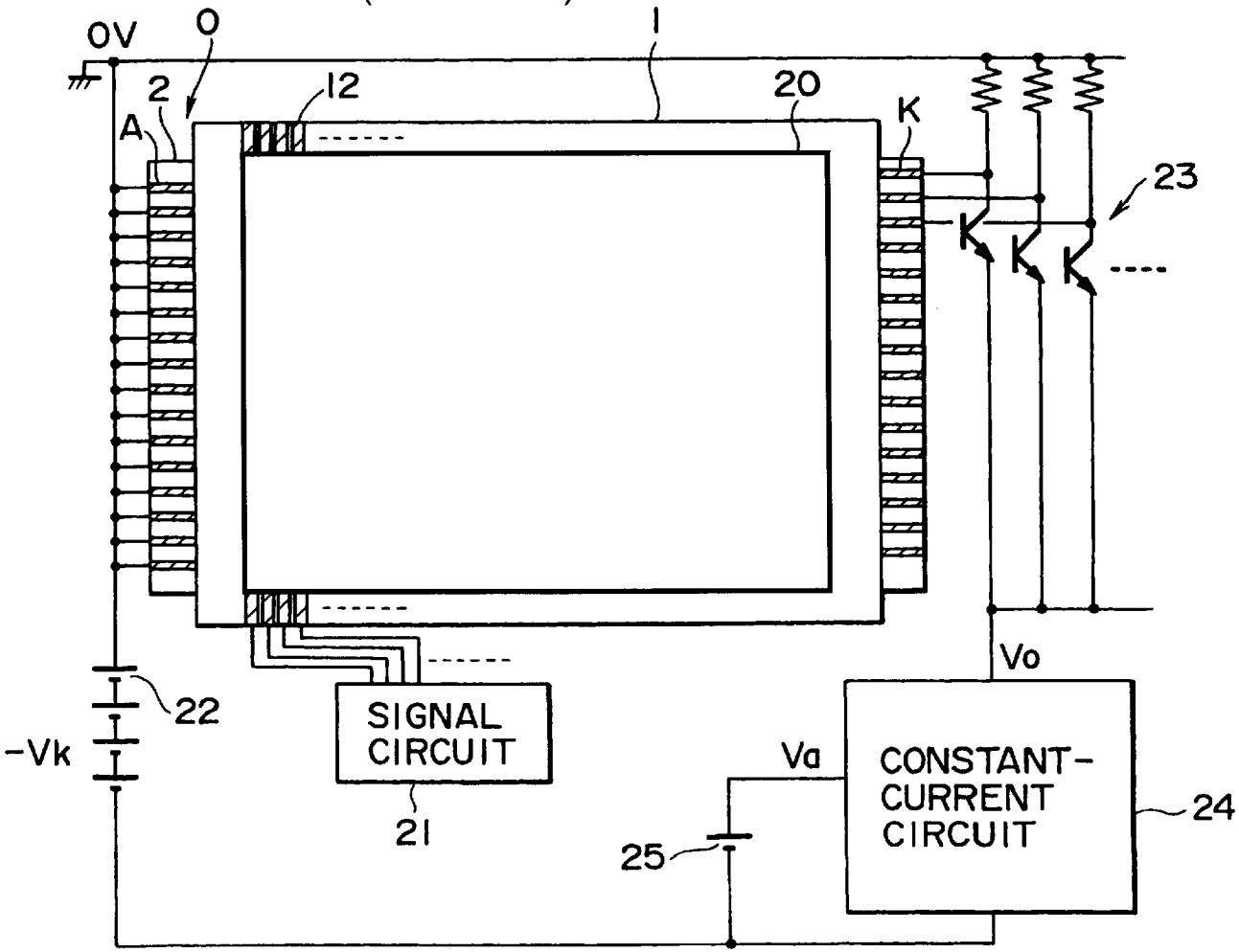
FIG. 7 (PRIOR ART)
FIG. 7 is a block diagram showing a plasma addressed display device in the related art.
Figure 8:
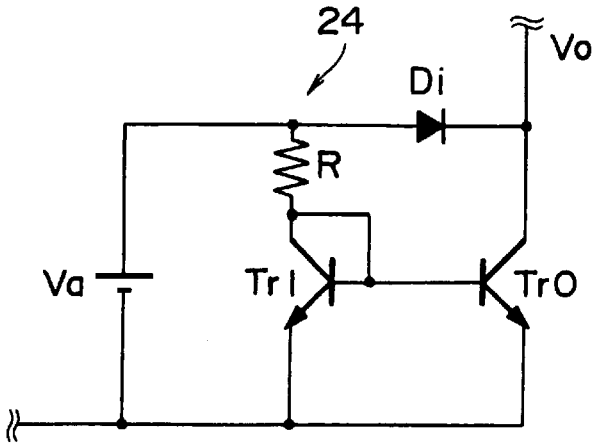
FIG. 8 (PRIOR ART)
FIG. 8 is a circuit diagram showing the configuration of a constant-current circuit incorporated in the conventional plasma addressed display device shown in FIG. 7.
Figure 9:
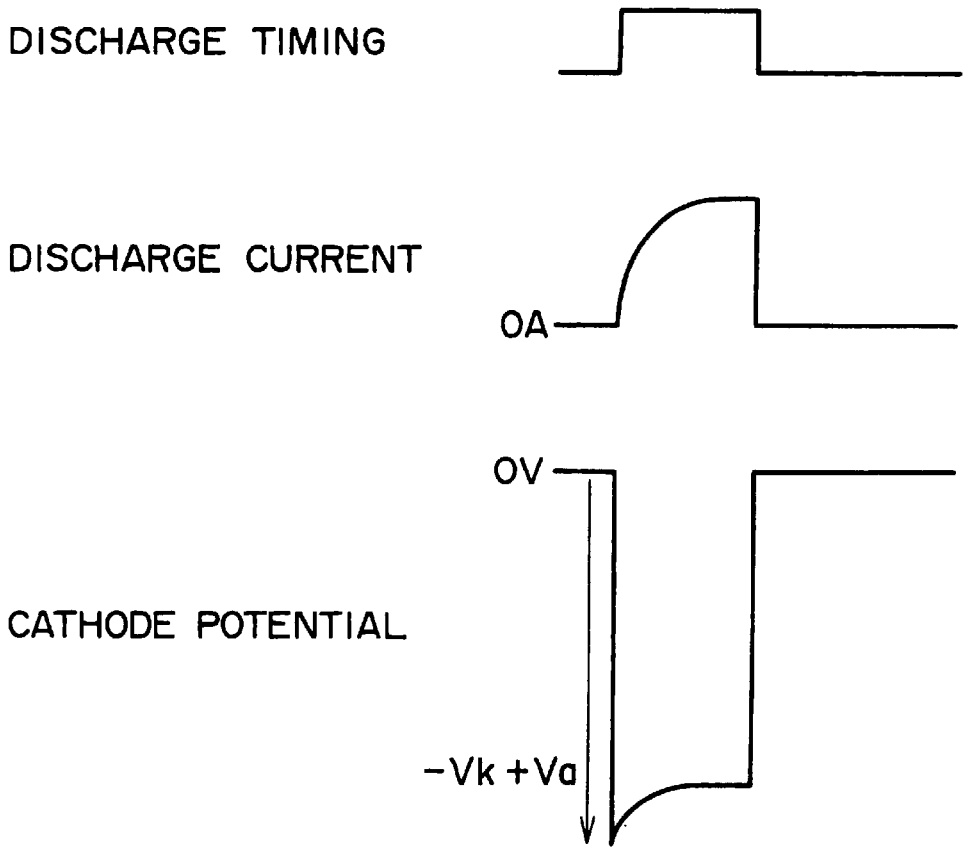
FIG. 9 (PRIOR ART)
FIG. 9 is a waveform chart for illustration of the operation of the constant-current circuit shown in FIG. 8.

FIG. 5 is a block diagram showing a third preferred embodiment of the plasma addressed display device according to the present invention. The third preferred embodiment has a basic configuration similar to that of the first preferred embodiment shown in FIG. 1, and substantially the same parts are denoted by the same reference numerals for ease of understanding. The difference between the first preferred embodiment and the third preferred embodiment is that the third preferred embodiment includes a main power supply 22*a* which is of a variable type and a detecting circuit 31 for directly controlling an output voltage of the main power supply 22*a* according to a sampled discharge voltage to adaptively control an applied voltage to each discharge channel. The detecting circuit 31 has a configuration similar to that of the detecting circuit shown in FIG. 2. The third preferred embodiment further includes a constant-current circuit 24 having a configuration similar to that of the constant-current circuit shown in FIG. 8.

As described above, according to the present invention, the detecting circuit samples a discharge voltage during flowing of a constant discharge current in each discharge channel, and the control circuit adaptively controls an applied voltage to be supplied to each discharge channel according to the discharge voltage sampled by the detecting circuit. More specifically, the applied voltage is set by adding a constant voltage value to a value of the sampled discharge voltage. With this configuration, a voltage near the sampled discharge voltage is applied to the cathode in each discharge channel at a discharge start timing, thereby preventing the generation of an arc discharge due to an excess applied voltage. Accordingly, the electrodes are not damaged, thereby allowing a long-life operation of the flat panel. Further, a voltage required for discharge is always applied irrespective of aged changes in discharge characteristics, thereby preventing instability of discharge. Further, setting of the discharge voltage in manufacturing the panel does not require a high accuracy because the circuits automatically follow.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A plasma addressed display device comprising:

a flat panel formed by laminating a plasma cell having a plurality of rows of discharge channels and a display cell having a plurality of columns of signal electrodes;

a drive circuit for sequentially supplying an applied voltage to each discharge channel to generate a plasma discharge in each discharge channel, thereby performing line-sequential scanning;

a signal circuit for supplying an image signal to each signal electrode in synchronism with said line-sequential scanning to thereby display an image;

a constant-current circuit operating so that a constant discharge current flows during maintenance of said plasma discharge in each discharge channel after an initial discharge initiation current;

a detecting circuit for sampling a substantially constant discharge voltage during flowing of said constant discharge current in each discharge channel; and a control circuit for adaptively controlling said applied voltage to be supplied to each discharge channel according to said substantially constant discharge voltage sampled by said detecting circuit.

2. A plasma addressed display device comprising:

a flat panel formed by laminating a plasma cell having a plurality of rows of discharge channels and a display cell having a plurality of columns of signal electrodes;

a drive circuit for sequentially supplying an applied voltage to each discharge channel to generate a plasma discharge in each discharge channel, thereby performing line-sequential scanning;

a signal circuit for supplying an image signal to each signal electrode in synchronism with said line-sequential scanning to thereby display an image;

a constant-current circuit operating so that a constant discharge current flows after generation of said plasma discharge in each discharge channel;

a detecting circuit for sampling a discharge voltage during flowing of said constant discharge current in each discharge channel; and a control circuit for adaptively controlling said applied voltage to be supplied to each discharge channel according to said discharge voltage sampled by said detecting circuit, wherein said control circuit sets said applied voltage by adding a constant voltage value to a value of said sampled discharge voltage.

3. A plasma addressed display device comprising:

a flat panel formed by laminating a plasma cell having a plurality of rows of discharge channels and a display cell having a plurality of columns of signal electrodes;

a drive circuit for sequentially supplying an applied voltage to each discharge channel to generate a plasma discharge in each discharge channel, thereby performing line-sequential scanning;

a signal circuit for supplying an image signal to each signal electrode in synchronism with said line-sequential scanning to thereby display an image;

a constant-current circuit operating so that a constant discharge current flows after generation of said plasma discharge in each discharge channel;

a detecting circuit for sampling a discharge voltage during flowing of said constant discharge current in each discharge channel; and a control circuit for adaptively controlling said applied voltage to be supplied to each discharge channel according to said discharge voltage sampled by said detecting circuit, wherein said control circuit controls said applied voltage to be supplied to said discharge channel of the next row according to said discharge voltage sampled from said discharge channel of a present row.

4. A plasma addressed display device comprising:

a flat panel formed by laminating a plasma cell having a plurality of rows of discharge channels and a display cell having a plurality of columns of signal electrodes;

a drive circuit for sequentially supplying an applied voltage to each discharge channel to generate a plasma discharge in each discharge channel, thereby performing line-sequential scanning;

a signal circuit for supplying an image signal to each signal electrode in synchronism with said line-sequential scanning to thereby display an image;

a constant-current circuit operating so that a constant discharge current flows after generation of said plasma discharge in each discharge channel;

a detecting circuit for sampling a discharge voltage during flowing of said constant discharge current in each discharge channel; and a control circuit for adaptively controlling said applied voltage to be supplied to each discharge channel according to said discharge voltage sampled by said detecting circuit, wherein said control circuit controls said applied voltage to be supplied to each discharge channel row by row in said line-sequential scanning at the next time according to said sampled discharge voltage in each discharge channel in said line-sequential scanning at a present time.

5. A plasma addressed display device, comprising:

a flat panel formed by laminating a plasma cell having a plurality of rows of discharge channels and a display cell having a plurality of columns of signal electrodes;

a drive circuit for sequentially supplying an applied voltage to each discharge channel to generate a plasma discharge in each discharge channel, thereby performing line-sequential scanning;

a signal circuit for supplying an image signal to each signal electrode in synchronism with said line-sequential scanning to thereby display an image;

a constant-current circuit operating so that a constant discharge current flows after generation of said plasma discharge in each discharge channel;

a detecting circuit for sampling a discharge voltage only during a time when said constant discharge current is flowing in each discharge channel; and a control circuit for adaptively controlling said applied voltage to be supplied to each discharge channel according to said discharge voltage sampled by said detecting circuit.

6. A plasma addressed display device, comprising:

a flat panel formed by laminating a plasma cell having a plurality of rows of discharge channels and a display cell having a plurality of columns of signal electrodes;

a drive circuit for sequentially supplying an applied voltage to each discharge channel to generate a plasma discharge in each discharge channel, thereby performing line-sequential scanning;

a signal circuit for supplying an image signal to each signal electrode in synchronism with said line-sequential scanning to thereby display an image;

a constant-current circuit operating so that a constant discharge current flows after generation of said plasma discharge in each discharge channel during each discharge event;

a detecting circuit for sampling a discharge voltage during flowing of said constant discharge current for a present discharge event in each discharge channel; and a control circuit for adaptively controlling said applied voltage to be supplied to each discharge channel for a subsequent discharge event according to said discharge voltage sampled by said detecting circuit.

* * * * *